US005329638A

United States Patent [19]

Hansen et al.

[11] Patent Number: 5,329,638

[45] Date of Patent: * Jul. 19, 1994

[54] PROTECTIVE WRISTBAND

[76] Inventors: Brian J. Hansen, 5717 21st Ave. South, Minneapolis, Minn. 55417; Stewart L. Hansen, 8305 West Bend Rd., Golden Valley, Minn. 55427

[ * ] Notice: The portion of the term of this patent subsequent to Sep. 29, 2009 has been disclaimed.

[21] Appl. No.: 938,434

[22] Filed: Aug. 31, 1992

Related U.S. Application Data

[63] Continuation-in-part of Ser. No. 625,074, Dec. 10, 1990, Pat. No. 5,150,475.

[51] Int. Cl.[5] ..... A41D 13/08

[52] U.S. Cl. ..... 2/16; 2/170

[58] Field of Search ..... 2/16, 170, 162, DIG. 11, 2/19, 267; 602/20–23

[56] References Cited

U.S. PATENT DOCUMENTS

| | | | |
|---|---|---|---|
| 241,224 | 5/1881 | Kleinert | 2/170 |
| D. 259,220 | 5/1981 | Small et al. | 2/170 |
| 2,952,021 | 9/1960 | Finn | 2/20 |
| 3,189,919 | 12/1963 | Chase | 2/24 |
| 3,598,408 | 8/1971 | Klose | 2/20 |
| 3,994,024 | 11/1976 | Bates | 2/19 |
| 4,068,318 | 1/1978 | McMahon | 2/170 |
| 4,150,442 | 4/1979 | Boone | 2/16 |
| 4,272,850 | 6/1981 | Rule | 2/24 |
| 4,374,439 | 2/1983 | Norman | 2/20 |
| 4,541,127 | 9/1985 | Gould | 2/161 A |
| 4,829,604 | 5/1989 | Allen et al. | 2/170 |
| 4,832,010 | 5/1989 | Lerman | 2/24 |
| 4,891,845 | 1/1990 | Hayes | 2/161 A |
| 4,896,378 | 1/1990 | Campana | 2/DIG. 6 |
| 4,928,320 | 5/1990 | Aoki | 2/28 |
| 4,947,488 | 8/1990 | Ashinoff | 2/DIG. 11 |
| 4,982,447 | 1/1991 | Henson | 2/2 |

OTHER PUBLICATIONS

Gean WristGuard document.

Wrist Pro Wrist Protector label.

Drawing of Hansen Sports Wrist Pro TM Wrist Protector.

Hansen Sports Wrist Pro Wrist Protector as shown in "Softball News", Apr. 1991.

Two page Hansen Sports Advertisement showing Hansen Sports Wrist Pro Wrist Protector.

Hansen Sports Wrist Pro Wrist Protector as shown in "Let's Play Softball", Jul. 4, 1991.

*Primary Examiner*—Clifford D. Crowder

*Assistant Examiner*—Amy B. Vanatta

*Attorney, Agent, or Firm*—Palmatier, Sjoquist & Helget

[57] ABSTRACT

A protective wristband with integrally woven inner and outer layers of an absorbent stretchable fabric material to provide an endless generally hollow interior, and a cushioned shield disposed between the layers such that the shield is concealed to provide the appearance of a conventional, unprotective wristband.

22 Claims, 4 Drawing Sheets

PROTECTIVE WRISTBAND

This is a continuation-in-part of copending application Ser. No. 07/625,074 filed on Dec. 10, 1990.

The present invention relates to wristbands and, more particularly, to protective wristbands.

BACKGROUND OF THE INVENTION

The wrist is a delicate instrument that is readily injured. For example, in softball or baseball the wrist is easily bruised or even broken by a sharp grounder taking a bad hop and striking the inside of the wrist. The inside of the wrist typically lies exposed, unprotected by a glove.

The prior art includes the Gould U.S. Pat. No. 4,541,127 which discloses a baseball protection device having a pad of pliable, shock-absorbent material and a sheet of hard, semi-rigid material, such as acetate plastic, superimposed on the pad. The pad and sheet are encased in a durable material such as leather or rawhide. The pad and sheet are secured to the wrist with a stretchable fabric, such as a blended fabric of elastic and perspiration-absorbing terry cloth, which is sewn to the outermost side edges of the pad and sheet.

The Campana U.S. Pat. No. 4,896,378 discloses a protective wrist band which particularly relates to protecting a mechanic's wrist. The wrist band includes an inner layer of porous, absorbent fabric material and a thicker shock-absorbing layer of a resilient, fluid-impervious, rubber-like closed cell material. The wrist band is secured above the wrist utilizing hook-and-loop fastening systems.

The Klose U.S. Pat. No. 3,598,408 discloses a wristlet and web protector with an athletic item engaging pad. The pad is secured to and within the area of the palm portion of a hand for engaging a bowling ball, golf club and the like.

The prior art also includes commercially available wrist protectors such as the HOT SHOT TM available from Mizuno marketed under U.S. Pat. No. 4,541,127.

SUMMARY OF THE INVENTION

A feature of the present invention is the provision in a protective wristband with inner and outer layers of absorbent, stretchable material, of a cushioned shield disposed between the layers of the band such that the cushioned shield is concealed to provide the appearance of a conventional, unprotective wristband.

Another feature is the provision in such a protective wristband, of the cushioned shield being slightly curved to fit comfortably over the wrist.

Another feature is the provision in such a protective wristband, of the cushioned shield having holes for ventilation.

Another feature is the provision in such a protective wristband, of the inner and outer layers being integrally woven together.

Another feature is the provision in such a protective wristband, of the inner and outer layers forming an endless generally hollow interior.

Another feature is the provision in such a protective wristband, of the cushioned shield being housed in a pocket and the pocket being secured to at least the inner layer of the band.

Another feature is the provision in such a protective wristband, of the band including a guard patch sewn over an inner edge of the band to protect the edge from wear and tear relative to an abrasive article such as a softball glove worn on the hand.

An advantage of the present invention is that it has the appearance of a conventional, unprotective wristband while providing a substantial degree of protection for the wrist against bad hops.

Another advantage is that the wristband may be worn such that the shield is positionable on the inside, outside, or side of the wrist. While baseball players may dispose the shield over the inside of the wrist, hockey players may position the shield over the side of the wrist to protect against slashing. Football linemen may wear the shield on the outside of the wrist. Wide receivers may locate the shield over the inside of the wrist. Generally, the wristband is positionable wherever protection is desired.

Another advantage is that the wristband may be slid up the arm to be positionable over the forearm where protection is desired.

Another advantage is that it is almost as absorbent as a conventional, unprotective wristband.

Another advantage is that the present protective wristband is almost as stretchable as a conventional, unprotective wristband.

Another advantage is that the present wristband may be utilized in many contact sports, including baseball and softball, hockey, football, martial arts, bandy, or non-contact sports such as volleyball.

Another advantage is that the protective wristband is inexpensive and simple to manufacture.

Another advantage is that the present protective wristband is machine washable in cold water and dryable on low heat.

DETAILED DESCRIPTION OF THE PREFERRED EMBODIMENTS

Figure 1:
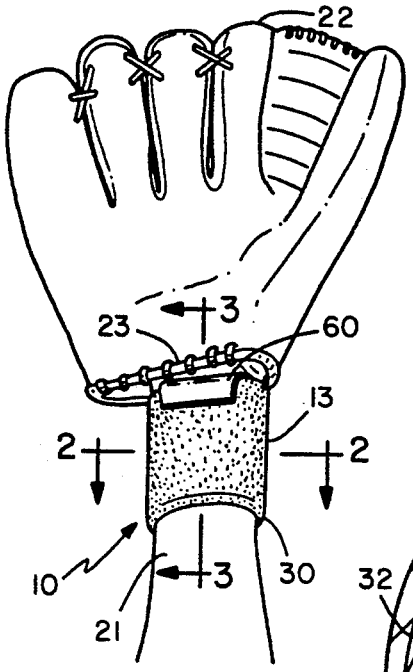
FIG. 1 is a perspective view of the present protective wristband on the wrist of a gloved hand.

As shown in FIG. 1, the present protective wristband is indicated in general by the reference numeral 10. The protective wristband 10 includes as its principal components a band 11 formed of an inner layer 12 and an outer layer 13, and a pocket 14 sandwiched between the layers 12, 13 and housing a hard protective shield 15 and a cushion 16.

The protective wristband 10 is typically worn on a wrist 20 and lower forearm 21 to lie adjacent to a glove 22 such as a baseball or softball or other like glove. The glove 22, as well as other like gloves, includes an inner rough edge 23. The glove 23 is worn on a hand 24 which naturally bends toward the lower forearm 21 and inside of the wrist 20. The inside of the wrist 20 is designated by the reference number 25 and may be referred to as the vein side of the wrist 20.

With more particularity, the band 11 is integrally woven such that the inner and outer layers 12, 13 are integrally connected via respective proximal and distal, integral connecting edges 30, 31. The layers 12, 13 and their integral edges 30, 31 form an endless, generally hollow, tubular-like interior 32. The band 11 is typically formed of terry cloth or a terry cloth-like material which is stretchable and elastic, absorbent for absorbing moisture such as perspiration, and breathable. The material forming the band 11 more specifically is 80% cotton, 10% nylon, and 10% rubber knit.

Pocket 14 is disposed within the band 11 by being sewn to the inner and outer layers 12, 13 with stitching of the same color as the wristband 10 to provide an outward appearance of a conventional, unprotective wristband. The pocket 14 is rectangular in shape and includes inner and outer sheets 40, 41 which are sewn together and fixed to the inner and outer layers 12, 13 via stitching 42 along four side portions 43. The pocket 14 is typically formed of a cotton or stretchable elastic, absorbent, breathable fabric such as terry cloth or a terry cloth-like material. The stitching 42 may also be elastic. It should be noted that the pocket 14 may be stitched only to the inner layer 12.

Figure 2:
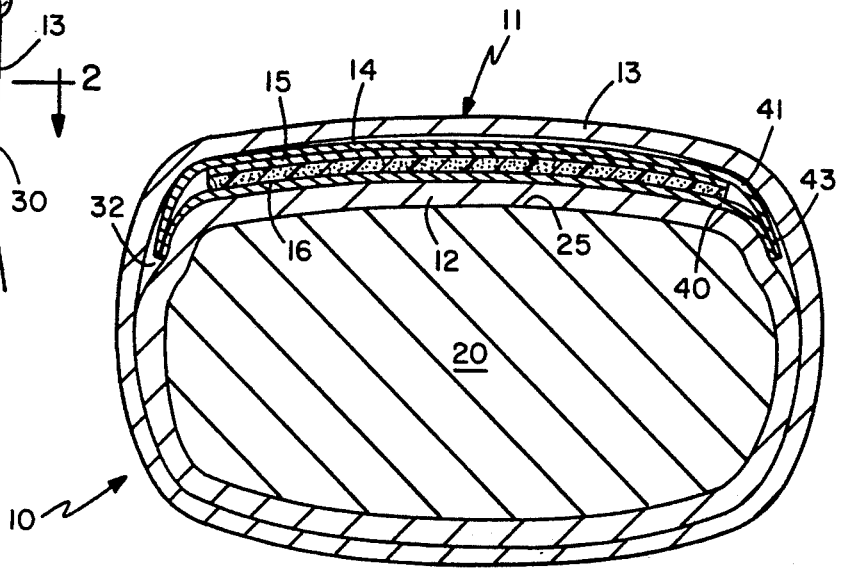
FIG. 2 is a section view at lines 2—2 of FIG. 1.
Figure 3:
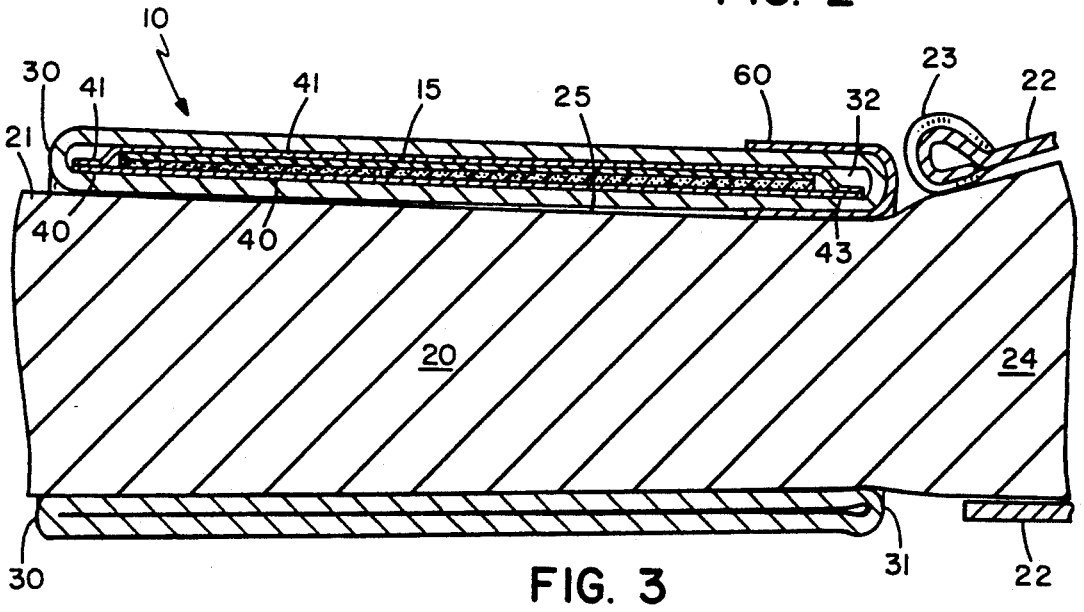
FIG. 3 is a section view at lines 3—3 of FIG. 1.

The cushioned shield 15 is housed in the pocket 14 and is preferably formed of a hard, rigid, plastic-like material. The shield 15 is generally rectangular in shape with rounded corners 50 for minimizing puncture of the shield 15 through the pocket 14. The shield 15 also includes apertures 51 for ventilation. As shown in FIG. 2, the shield 15 has a slight curvature with an outer face being convex and an inner face being concave such that the shield 15 somewhat follows the curvature of the wrist 20 to fit comfortably about the wrist 20. The material forming the shield 15 is preferably water resistant or waterproof to be machine washable, and heat resistant to be machine dryable.

The cushion 16 is secured to the shield 15 to absorb the impact transmitted by a ball or hockey puck through the shield 15. The cushion 16 is approximately equal in width and length to the shield 15, but is typically slightly greater in thickness. The cushion 16 follows the curvature of the shield 15 and confronts the inner sheet 40. The cushion 16 is typically formed of a resilient, substantially waterproof material such that the protective wristband 10 is washable. The cushion 16 is also sufficiently heat resistant to be machine dryable on low heat cycle. It should be noted that the shield 15 and cushion 16 may be a substantially integral, one-piece shield formed of a semi-rigid pliant material, or a multiple piece shield. One pliable material which may be utilized is HDPE-polyethylene. Such pliable material allows the shield 15 to be customized to fit the unique shape of an individual's wrist or the area of protection which is desired.

A nylon or nylon-like guard strip 60 is stitched via stitching 61 to the inner and outer layers 12, 13 and extends over a portion of the integral distal connecting edge 31 to guard against chaffing and wear and tear of the rough edge 23 of the glove 22 upon the integral distal edge 31. The strip 60 extends inwardly sufficiently to extend over portions of the shield 15 and cushion 16. The stitching 61 may be elastic to aid in the overall elasticity of the protective wristband 10. It should be noted that the strip 60 may provide for a more durable wristband 10, although the strip 60 may be absent for aesthetic purposes and is therefore optional.

In operation, the wristband 10 is placed on the wrist 20 by simply being stretched and slipped over the hand 24. The cushion shield 15 is disposed over the inside face 25 of the wrist 20. In this position, the guard patch 60 is adjacent to rough edge 23 of the glove 22. In appearance, the protective wristband 10 looks like a conventional unprotective wristband.

When an object such as a baseball or softball strikes the protective wristband 10 over the cushioned shield 15, it transmits a force that spreads out over the shield 15 and that is absorbed at least partially by cushion 16. Hence, a lesser force is brought to bear on the inside face 25 of the wrist 20.

When in place on the wrist 20, the protective wristband 10 absorbs perspiration. In particular, the inner layer 12 absorbs the perspiration, which is subsequently drawn by capillary action in a wick-like fashion through the integral connecting edges 30, 31 to the outer layer 13 where it is exposed to the air and evaporates. The hollow interior 32 also contributes to a drying of the wristband 10 as it allows ventilation between the layers 12, 13.

For removal from the wrist 24, the wristband 10 is simply stretched slightly and slipped over the hand 24. The wristband 10 may then be washed in cold water such as in a conventional washing machine and air dried or dried in a conventional dryer, under gentle extra low cycle.

Figure 5:
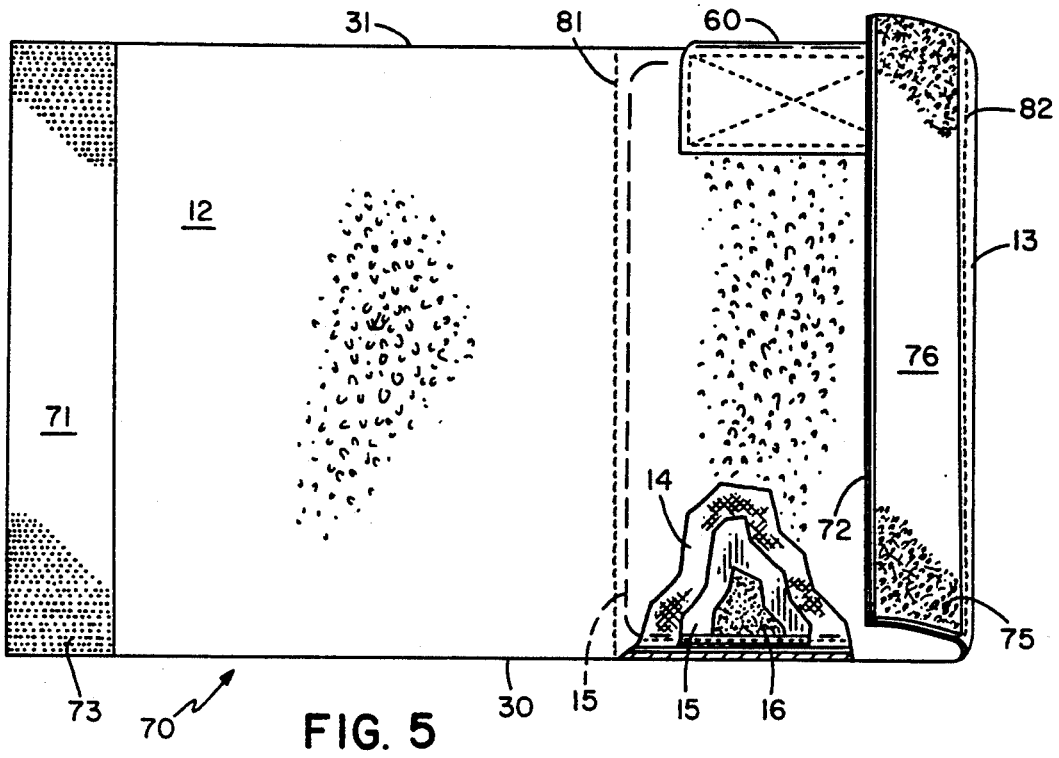
FIG. 5 is an elevation, partially broken away view of an alternate embodiment of the invention.

As shown in FIG. 5, in an alternate embodiment of the invention, an alternate protective wristband 70 includes ends 71, 72. Each of the ends 71, 72 includes rectangular sections of nylon material extending over and sewn to each of the inner and outer layers 12, 13. Hook-type fasteners 73 extend from a face 74 of end 71 to effectively extend from inner layer 12. Loop-type fasteners 75 extend from a face 76 of end 72 to effectively extend from outer layer 13. The hook-type fasteners 73 and the loop-type fasteners 75 may be the material marketed under the trademark Velcro TM. The pocket 14, including the shield 15 and cushion 16, are housed between the layers 12, 13 in a hollow pocket portion 80 defined by stitching 81, end 76, and connecting edges 30, 31. Stitching 81 is woven through both layers 12, 13. Stitching 81 may be the same color as the outer layer 13 so as to provide the appearance of a conventional wristband. If desired, the pocket 14 may be eliminated from this embodiment as the cushioned shield 15 is retained in pocket portion 80 via the stitching 81 and end 76, which includes stitching 82. It should be noted that a hollow portion 85 is defined by end 71, stitching 81, and edges 30, 31.

Figure 6:
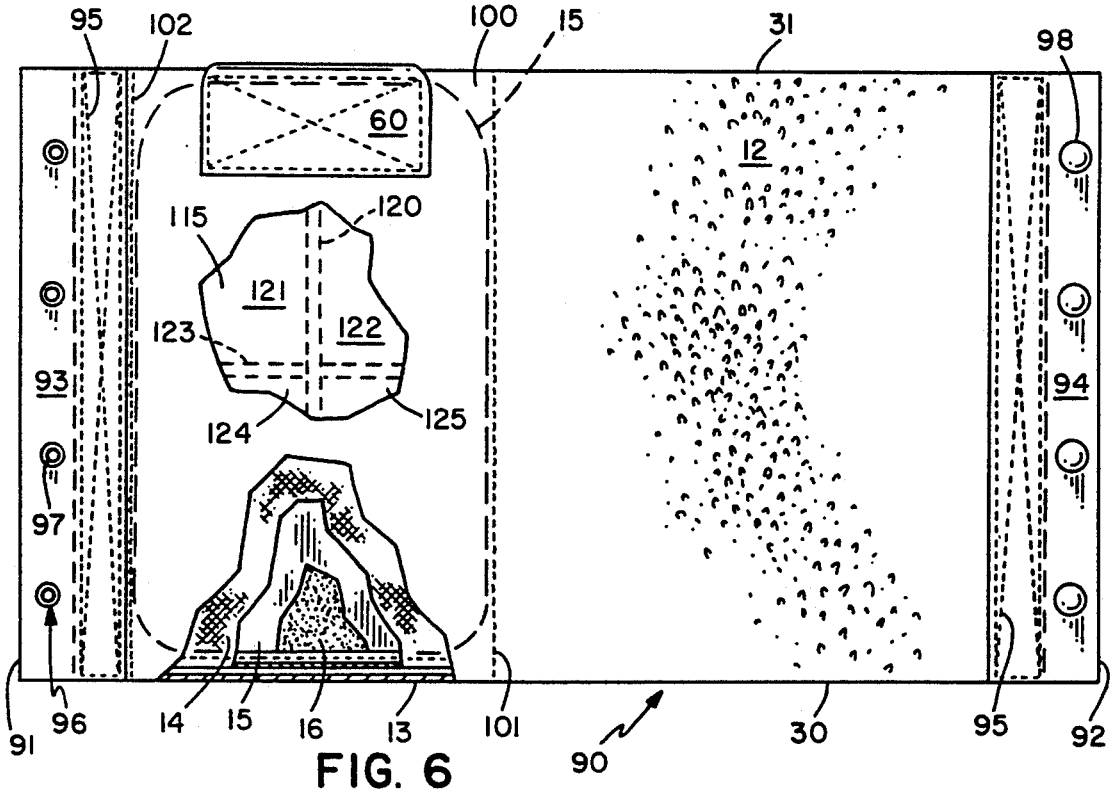
FIG. 6 is an elevation, partially broken away view of an alternate embodiment of the invention.

As shown in FIG. 6, in an alternate embodiment of the invention, an alternate protective wristband 90 includes ends 91, 92 formed of respective rectangular strips of nylon material 93, 94 covering portions of both the inner and outer layers 12, 13. The nylon material 93, 94 is sewn to the ends 91, 92 via stitching 95. Snap portions 96 with nubs 97 extending effectively from layer 12 are secured on end 91. Snap portions 98 are secured on end 92 and include recesses depressed relative to layer 13. Snap portions 96–98 cooperate to secure the wristband 90 about a wrist. A hollow pocket portion 100 is defined by stitching 101, 102, and connecting edges 30, 31, and secures the pocket 14, shield 15, and cushion 16. Stitching 101, 102 is typically the same color as the outer layer 13 to provide the appearance of a conventional wristband, as the stitching 101, 102 typically extends through both layers 12, 13. It should be noted that a hollow interior 105 is defined by stitching 101, end 92, and edges 30, 31.

As also shown in FIG. 6, in an alternate embodiment of the invention, the shield 15 may be a multi-piece shield 115. Phantom lines 120 indicate a longitudinal separation and phantom lines 123 indicate a lateral separation to define four separate shield portions 121, 122, 124, 125. The four shield portions 121, 122, 124, 125 are typically connected by the underlying foam 16, but may be connected by any flexible material. The multi-piece shield 115 may include only the longitudinal line of separation 121 such that pieces 121, 124 are integral and pieces 122, 125 are integral. Likewise, the shield 115 may include only the lateral line of separation 123 such that pieces 121, 122 are integral and pieces 124, 125 are integral. These multi-piece shields may provide a more flexible and hence more comfortable fit than the one-piece shield 15. The pieces 121, 122, 124, 125 may be rigid or semi-rigid.

Figure 7:
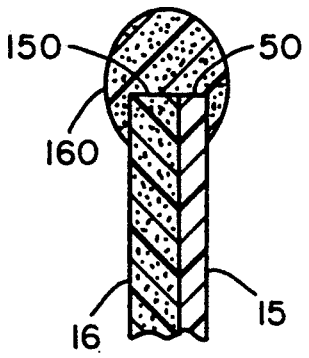
FIG. 7 is a partial, section view of a portion of the shield and cushion of the present protective wristband.

As shown in FIG. 7, the rounded corner 50 of the shield 15 and a common rounded corner 150 of the cushion 16 may be set in a strip of padding 160 to protect the pocket 14 from wear and tear created by the hard shield 15 and its cushion 16. Such padding 160 may be applied only along the rounded corners 50 or may extend about the entire peripheral edges of the shield 15 and cushion 16.

Figure 4:
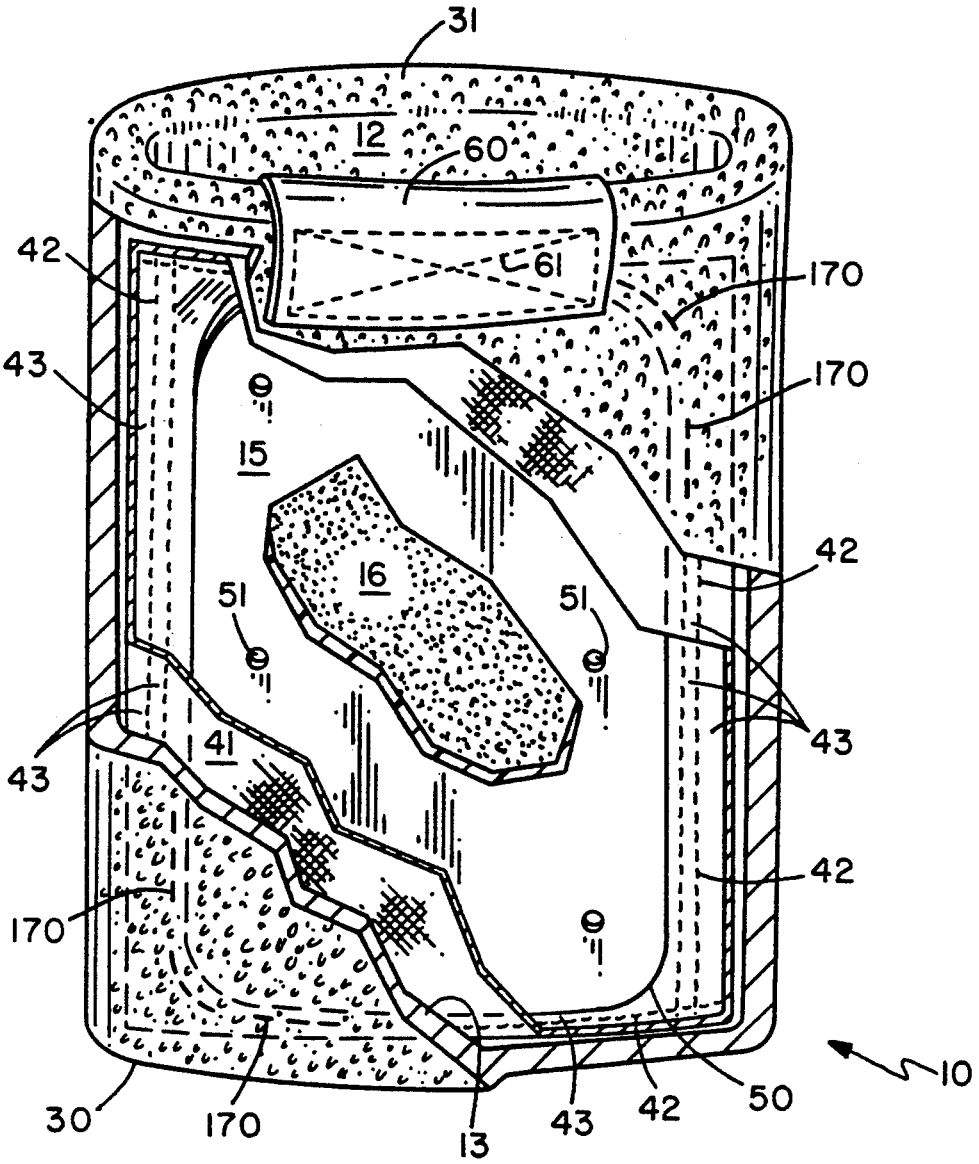
FIG. 4 is a detail, perspective, partially broken away view of the protective wristband of FIG. 1.

As shown in FIG. 4, in another alternate embodiment of the invention, the pocket 14 may be absent and the shield 15 and cushion 16 may be retained in place by spot stitches 170 spaced about the periphery of the shield 15. Such spot stitches 170 extend through both inner and outer layers 12, 13 and are typically placed adjacent to the four corners 50 to maintain a substantially endless hollow interior 32. However, it should be noted that such stitching 170 may extend about the entire periphery of the shield 15. It should be noted that such stitching, as it extends through the outer layer 13 is typically the same color as the band 11 to maintain the appearance of a conventional, unprotected wristband.

Figure 8:
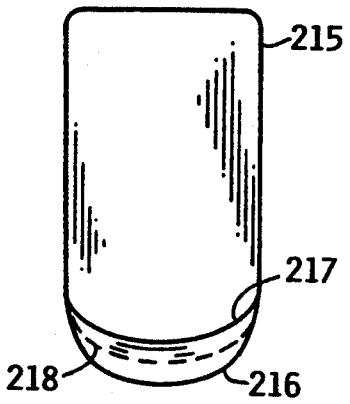
FIG. 8 is an elevation view of an alternate embodiment of the invention with the cushion extending slightly beyond an edge of the shield to be sewn to the layers of the wristband.

As shown in FIG. 8, in an alternate embodiment of the invention, a protective shield 215 includes an underlaying cushion 216 of flexible material which extends slightly from a curved edge 217 of the shield 215. Stitching 218 through the cushion 216 and the inner and/or outer layers 12, 13 secures the cushion 216 and shield 215 to the band 11. The stitching 218 may be adjacent either of the edges 30, 31, but is preferably adjacent edge 31. It should also be noted that the cushion 216 may extend from all four edges of the shield 215 for being stitched to the band 11.

Figure 9:
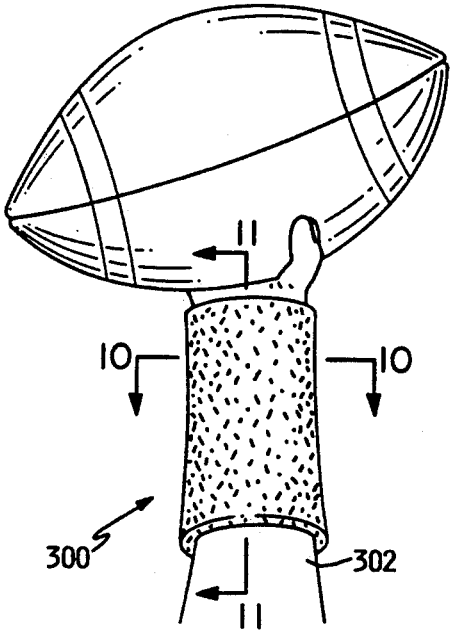
FIG. 9 is a perspective view of an alternate embodiment of the invention.
Figure 10:
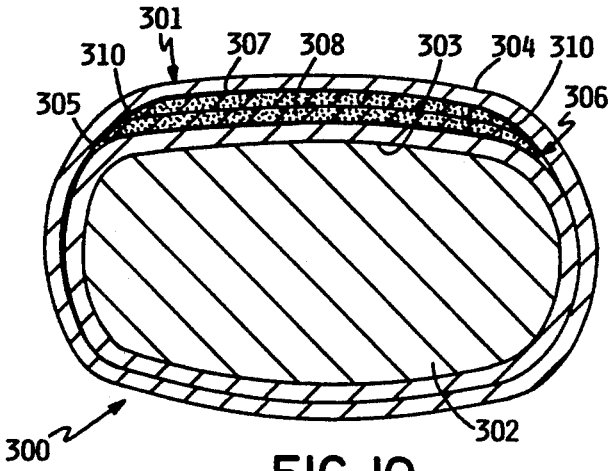
FIG. 10 is a section view at lines 10—10 of FIG. 9.
Figure 11:
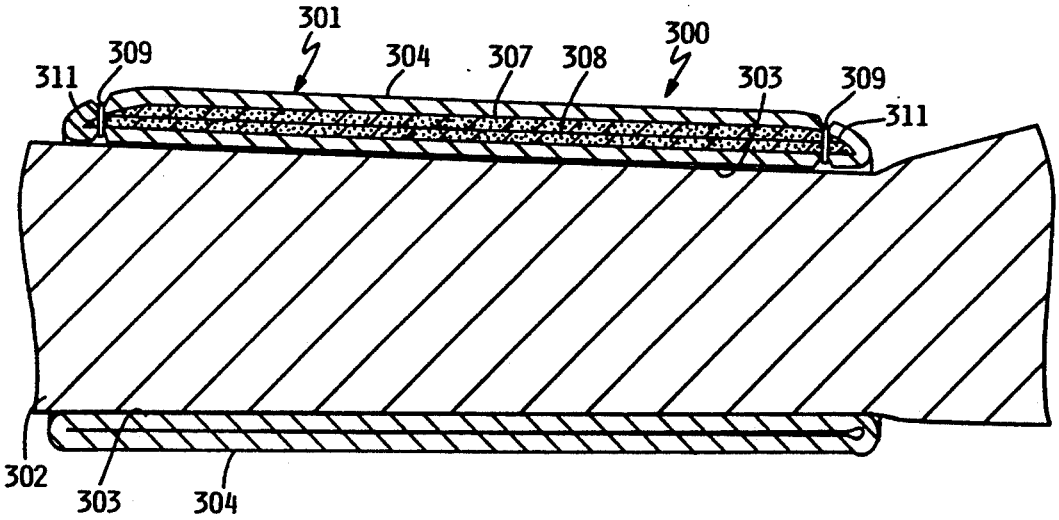
FIG. 11 is a section view at lines 11—11 of FIG. 9.

In an alternate embodiment of the invention, as shown in FIGS. 9–11, a football wrist protector 300 includes a terry cloth tubular band 301 to encircle a wrist 302. The band 301 includes inner and outer respective layers 303, 304 of terry cloth which are integrally connected to be tubular to form an endless hollow interior 305 in which a protector 306 is disposed. The protector 306 includes an upper shield 307 formed of a semi-rigid, first closed cell foam. The shield 307 is secured, such as by gluing, to a lower underlying cushion 308 formed of a second closed cell foam to offer a greater cushioning effect than the upper shield 307, which is of a greater hardness to receive the impact of a blow. In other words, the shield 307 includes a greater degree of stiffness than the cushion 308. This stiffness or firmness is believed to be controlled by the amount of crosslinking agent in the foam. The protector 306 may be stitched at opposite ends to the band 301 to secure the protector 306 in generally one place in the band 301. Such stitching is indicated by reference numerals 309. If desired, such stitching may be disposed on the sides of the protector 306. The length of the wrist protector 300 is typically at least twice as long as its width since this embodiment is intended for use on the football field or other contact sports where blocking-like blows may occur more often where the wrist leads into the forearm. The width of the shield 307 and cushion 308 is approximately equal to the width of the wrist and are one-piece across the width of the wrist. To be positioned where protection is desired, the protector 300 is freely rotatable on the wrist. If desired, only one of the closed cell foam layers 307, 308 may be utilized.

Other materials that are flexible, bendable, and/or made from closed cell material and that resist water and that absorb shock may also be used for the protector 306. Such material may not be limited to foam or plastic materials. It should be noted that a hard plastic protector may be illegal in some sports.

If desired, the side edges of the protector 306 may be beveled as indicated by reference numeral 310 as shown in FIG. 10, to provide a more sculptured look to the wrist protector 300 as a whole. The top and bottom edges may also be beveled as shown by reference numeral 311 in FIG. 11.

Figure 12:
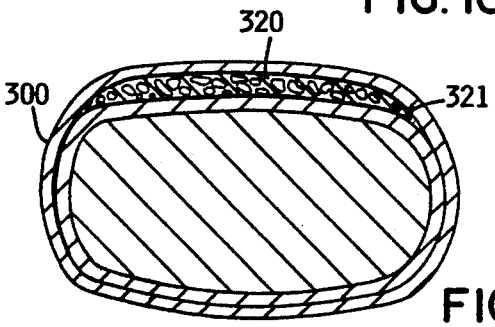
FIG. 12 is a section view of an alternate embodiment of the invention having a gel pack for a protective shield.

As shown in FIG. 12, the tubular wristband 300 may include a gel pack 320 as a protective shield. The gel pack 320 includes a periphery 321 of plastic (or fabric if desired) to be stitched to the band 300. The gel pack 320 preferably includes a gel formed of a mixture of water and propylene glycol. The gel may also include gel agents such as metacel and bittering agents. The gel pack 320 serves a dual purpose. First, it may be utilized alone as a protective shield as shown in FIG. 12, or it may be substituted for the cushion 308 or shield 307 in FIGS. 10, 11. Second, it may be cooled for use as a cold pack to be placed over an injury such as a bruise to reduce swelling.

Figure 13:
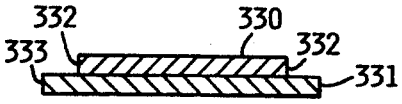
FIG. 13 is a section partial view of the preferred embodiment of the protector for use in football.

As shown in FIG. 13, the preferred embodiment of a football protector to be placed inside of a terry cloth tubular wristband includes two layers of foam 330, 331 formed of a material identical to layers 307, 308. Instead of including beveled edges 310, 311, the upper stiffer layer 330 is slightly reduced in size to provide a tapered look to the terry cloth outer layer 304. In other words, at least the side edges 332 of layer 330 are spaced inwardly from the side edges 333 of the less stiff layer 331. If desired, the entire periphery of 330 may be spaced inwardly of the entire periphery of layer 331.

It should be noted that the beveled effect may be provided on a one-piece pad where the pad is formed of a material which may be injection molded, such as closed cell foam. Pad 320 may indicate such a one-piece pad formed of closed cell foam instead of a gel.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A cloth, freely rotatable, tubular, protective wristband to readily absorb sweat and protect a wrist against blows and have the aesthetic appearance of a conventional unprotective wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist, said band further comprising a hollow pocket portion defined by the affixation of a portion of said inner layer to a portion of said outer layer; and b) a resilient shield being at least semi-rigid and having an underlying cushion, said resilient shield and cushion being inserted into said hollow pocket portion, said resilient shield and cushion having a width which is approximately equal to the width of said wrist, said resilient shield and cushion being disposed inside said hollow pocket portion between said layers of said band such that said resilient shield and cushion are concealed to provide the conventional, unprotective wristband appearance.

2. The invention of claim 1, wherein said resilient shield and cushion are attached so as to form one piece across the width of said wrist.

3. The invention of claim 1, wherein said resilient shield comprises plastic.

4. The invention of claim 1, wherein said resilient shield comprises a pad having a greater degree of stiffness than the underlying cushion.

5. The invention of claim 1, wherein said cushion includes a greater periphery than said resilient shield to provide a tapered look to said outer layer of the terry cloth adjacent the periphery.

6. The invention of claim 1, wherein said resilient shield and underlying cushion are elongate extending toward the elbow of an individual wearing said protective wristband to define a length of said resilient shield and cushion, the length being approximately at least twice as great as the width of said resilient shield and cushion.

7. A cloth, freely rotatable, tubular, protective wristband to readily absorb sweat and protect a wrist against blows and have the aesthetic appearance of a conventional unprotective wristband, comprising:

a) a tubular band to encircle said wrist and comprising inner and outer layers of cloth, said layers being integrally connected to form a hollow interior portion, a portion of said layers being integrally connected to form a hollow pocket portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist; and b) a resilient shield being at least semi-rigid and having an underlying cushion, said resilient shield and cushion being positioned within said hollow pocket portion, said resilient shield and cushion having a width which is approximately equal to the width of said wrist, said resilient shield and cushion being attached so as to form one piece across the width of said wrist, said resilient shield and cushion being disposed between said layers of said band such that said resilient shield and cushion are concealed to provide the conventional, unprotective wristband appearance.

8. A cloth, freely rotatable, tubular, protective wristband to readily absorb sweat and protect a wrist against blows and have the aesthetic appearance of a conventional unprotective wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist, said band further comprising a hollow pocket portion defined by the affixation of a portion of said inner layer to a portion of said outer layer; and b) a resilient shield having an underlying cushion, said resilient shield and cushion being inserted into said hollow pocket portion, said resilient shield having a greater degree of stiffness than said underlying cushion, said resilient shield and cushion having a width which is approximately equal to the width of said wrist, said resilient shield and cushion being elongate to extend toward the elbow of an individual wearing said band to define a length, the length of said resilient shield and cushion being approximately at least twice as great as the width of said resilient shield and cushion, said resilient shield and cushion being attached so as to form one piece across the width of said wrist, said resilient shield and cushion being disposed between said layers of said band such that said resilient shield and cushion are concealed to provide the conventional, unprotective wristband appearance.

9. A tubular, freely rotatable, protective wristband to readily absorb sweat and protect a wrist against blows and have the aesthetic appearance of a conventional unprotective wristband, comprising:

a) a tubular band to encircle said wrist and being formed of a stretchable and absorbent material, a portion of said stretchable and absorbent material being integrally connected to form a hollow pocket portion, said band having a diameter which is approximately equal to the diameter of said wrist, said band being freely rotatable on said wrist; and b) a resilient shield having an underlying cushion, said resilient shield and cushion being inserted into said hollow pocket portion, said resilient shield and cushion having a width which is approximately equal to the width of the wrist, said resilient shield comprising a pad having a greater degree of stiffness than said cushion, said resilient shield and cushion being disposed in said hollow pocket portion such that said resilient shield and cushion are concealed to provide the conventional, unprotective wristband appearance.

10. The wristband of claim 9, wherein said pad and cushion each comprise a closed cell foam of distinct density, the closed cell foam of said pad having a greater degree of stiffness and density than the closed cell foam of said cushion.

11. A protective wristband for protecting a wrist, comprising:

a) a band to encircle said wrist and comprising inner and outer layers of absorbent, stretchable material, the layers being integrally connected to form a hollow interior portion, the inner layer confronting said wrist, said band having a diameter which is approximately equal to the diameter of said wrist when on said wrist, a portion of said stretchable and absorbent material being integrally connected to form a hollow pocket portion; and b) a resilient shield being at least semi-rigid and having an underlying cushion, said resilient shield and cushion being disposed inside said hollow pocket portion of said band such that said resilient shield is concealed to provide the appearance of a conventional, unprotective wristband.

12. A cloth, freely rotatable, tubular, protective wristband to readily absorb sweat and protect a wrist against blows and have the aesthetic appearance of a conventional unprotective wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist, a portion of said inner and outer layers being integrally connected to form a hollow pocket portion; and b) a pad fastened to said band, said pad having a width being approximately equal to the width of said wrist, said pad being disposed inside said hollow pocket portion such that said pad is concealed to provide the conventional, unprotective wristband appearance.

13. The wristband of claim 12, wherein said pad comprises a gel.

14. The wristband of claim 12, wherein the cloth comprises cotton, nylon, and rubber knit.

15. The wristband of claim 12, wherein said pad includes beveled side edges tapering outwardly from an upper surface of said pad to a lower surface of said pad.

16. The wristband of claim 15, wherein said pad further includes additional beveled edges between said side edges, said additional beveled edges tapering outwardly from said upper surface of said pad to said lower surface of said pad.

17. The wristband of claim 12, wherein said pad includes two portions, one of said portions confronting said wrist, the other portion having a lesser periphery than said portion confronting said wrist whereby said band tapers about the periphery.

18. A cloth, freely rotatable, tubular, protective wristband to readily absorb sweat and protect a wrist against blows and having the aesthetic appearance of a conventional unprotective wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist, a portion of said inner and outer layers being integrally connected to form a hollow pocket portion; and b) a resilient multi-piece shield being at least semi-rigid and having an underlying cushion, said resilient multi-piece shield and cushion being inserted into said hollow pocket portion wherein each piece of said multi-piece shield has corners which are set in a strip of padding to protect said hollow pocket portion, said resilient multi-piece shield and cushion having a width which is approximately equal to the width of said wrist, said resilient multi-piece shield and cushion being disposed inside said hollow pocket portion between said layers of said band such that said resilient multi-piece shield and cushion are concealed to provide the conventional unprotected wristband appearance, said resilient multi-piece shield further including an outer periphery, said cushion including a greater periphery than said outer periphery of said resilient multi-piece shield to provide a tapered look to said outer layer of the cloth adjacent the periphery of said cushion.

19. A cloth, freely rotatable, tubular, protective wristband to readily absorb sweat and protect a wrist against blows and have the aesthetic appearance of a conventional unprotective wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on said wrist; and b) a resilient multi-piece shield being at least semi-rigid and having an underlying cushion, wherein said resilient multi-piece shield includes an exterior and a boundary edge wherein each piece of said resilient multi-piece shield has corners, said underlying cushion comprising a flexible material extending to the exterior of said boundary edge of said resilient multi-piece shield, wherein said resilient multi-piece shield is maintained in generally one place between said inner and outer layers by stitching disposed at least partially about said boundary edge, said resilient multi-piece shield and cushion having a width which is approximately equal to the width of said wrist, said resilient multi-piece shield and cushion being disposed between the layers of said band such that said resilient multi-piece shield and cushion are concealed to provide the conventional, unprotective wristband appearance, said cushion including a periphery extending beyond said boundary edge to provide a tapered appearance for said outer layer of said cloth adjacent said periphery of said cushion.

20. A cloth, freely rotatable, tubular, protective wristband to readily absorb sweat and protect a wrist against blows and have the aesthetic appearance of a conventional unprotected wristband, comprising:

a) a tubular band to encircle said wrist and comprising inner and outer layers of cloth, said layers being integrally connected to form a hollow interior portion, said cloth being absorbent to absorb sweat and stretchable to stretch over a hand and onto said wrist, said inner layer confronting said wrist, said band having a diameter which is approximately equal to the diameter of said wrist when on said wrist, said band being freely rotatable on the wrist; and b) a resilient shield being at least semi-rigid and having an underlying cushion, wherein said resilient shield includes an exterior and a boundary edge, said underlying cushion comprising a flexible material extending to the exterior of said boundary edge of said resilient shield, wherein said resilient shield is maintained in generally one place between said inner and outer layers by spot stitching disposed about said boundary edge, said resilient shield having a width which is approximately equal to the width of said wrist, said resilient shield and cushion being disposed between said layers of said band such that said resilient shield and cushion are concealed to provide the conventional, unprotective wristband appearance.

21. A protective wristband for protecting a wrist, comprising:

a) a band to encircle the wrist comprising inner and outer layers of absorbent, stretchable material, the layers being integrally connected to form a hollow interior portion and a hollow pocket portion, the inner layer confronting the wrist, the diameter of the band being approximately equal to the diameter of the wrist when on the wrist; and b) a shield comprising a resilient portion and being disposed between the layers of the band, the shield including an edge and a flexible material extending to a position proximate to said edge of said shield, the shield and flexible material being secured to said band by positioning within said hollow pocket portion such that the shield is concealed to provide the appearance of a conventional, unprotective wristband.

22. A protective wristband for protecting a wrist, comprising:

(a) a band to encircle the wrist comprising inner and outer layers of absorbent, stretchable material, the layers being integrally connected to form a hollow interior portion, the inner layer confronting the wrist, the diameter of the band being approximately equal to the diameter of the wrist when on the wrist; and (b) a shield comprising a resilient portion being disposed between the layers of the band, the shield including an edge an a flexible material extending to the edge, the flexible material and shield being securely positioned within the hollow interior portion of the band such that the shield and flexible material are concealed to provide the appearance of a conventional, unprotective wristband.

* * * * *